United States Patent [19]

Kobayashi et al.

[11] Patent Number: 4,604,979

[45] Date of Patent: Aug. 12, 1986

[54] ELECTRONICALLY CONTROLLED DISTRIBUTOR TYPE FUEL INJECTION PUMP FOR INTERNAL COMBUSTION ENGINES

[75] Inventors: Tadashi Kobayashi; Shinya Nozaki; Keiichi Yamada, all of Higashi-matsuyama, Japan

[73] Assignee: Diesel Kiki Co., Ltd., Tokyo, Japan

[21] Appl. No.: 718,806

[22] Filed: Apr. 2, 1985

[30] Foreign Application Priority Data

Apr. 5, 1984 [JP] Japan ..... 59-49875[U]

[51] Int. Cl.[4] ..... F02M 59/20

[52] U.S. Cl. ..... 123/449; 123/458; 123/459; 123/460; 123/179 G

[58] Field of Search ..... 123/449, 458, 459, 460, 123/511, 512, 198 D, 198 DB, 179 G

[56] References Cited

U.S. PATENT DOCUMENTS

| | | | |
|---|---|---|---|
| 4,475,507 | 10/1984 | Miyaki et al. | 123/459 |
| 4,502,445 | 3/1985 | Roca-Nierga et al. | 123/458 |
| 4,519,353 | 5/1985 | Ito et al. | 123/458 |

FOREIGN PATENT DOCUMENTS

| | | | |
|---|---|---|---|
| 46-36410 | 10/1971 | Japan | 123/449 |
| 47-14172 | 4/1972 | Japan | 123/449 |
| 65857 | 4/1982 | Japan | 123/458 |
| 57-91366 | 7/1982 | Japan . | |

*Primary Examiner*—Magdalen Y. C. Moy

*Attorney, Agent, or Firm*—Frishauf, Holtz, Goodman & Woodward

[57] ABSTRACT

A suction space is disposed to selectively communicate with a pump working chamber defined at one end of a plunger via a first communication passageway in which a solenoid valve is arranged, or with suction ports formed in the plunger and communicating with the pump working chamber via a second communication passageway having a restriction therein. The solenoid valve alternately opens and closes for ordinary fuel injection during operation of the engine other than at the start thereof. A selector valve keeps the first communication passageway closed and simultaneously keeps the second communication passageway opened for fuel injection through collaboration of the suction ports with the second communication passageway, in place of the alternate opening and closing of the solenoid valve.

5 Claims, 4 Drawing Figures

ELECTRONICALLY CONTROLLED DISTRIBUTOR TYPE FUEL INJECTION PUMP FOR INTERNAL COMBUSTION ENGINES

BACKGROUND OF THE INVENTION

This invention relates to an electronically controlled distributor type fuel injection pump adapted for use in internal combustion engines, particularly in diesel engines.

Among conventional distributor type fuel injection pumps, an electronically controlled type is known, e.g. from Japanese Provisional Patent Publication (KOKAI) No. 57-91366, wherein the fuel injection quantity and injection timing of the fuel injection pump is electrically controlled. According to this proposed type, a governor, an injection timing control device and a control sleeve are omitted from the fuel injection pump, but a single solenoid valve is employed instead for controlling the fuel injection quantity and the injection timing through its opening and closing actions, in such a manner that the fuel injection is initiated upon opening of the solenoid valve and terminated upon closing of same. Therefore, the solenoid valve is required to have high responsiveness enough to fully exhibit these functions. However, even highly responsive solenoid valves cannot satisfactorily exhibit their responsiveness at the start of the engine in cold weather such as in winter when the fuel is low in temperature and accordingly high in viscosity, and in addition the supply voltage from the battery is low, which can cause inconveniences such as deteriorated startability of the engine.

Further, in these electronically controlled fuel injection pumps, when the solenoid valves per se or the control means for driving them fail or malfunction, proper operation of the solenoid valves cannot be performed, resulting in interruption of the fuel injection and accordingly stoppage of the engine operation.

SUMMARY OF THE INVENTION

It is an object of the invention to provide a distributor type fuel injection pump which is capable of performing fuel injection without using the solenoid valve at the start of the engine, particularly in cold weather, to thereby ensure required startability of the engine, and also which does not require a high grade of responsiveness of the solenoid valve.

It is a further object of the invention to provide a distributor type fuel injection pump which is capable of continuing the fuel injection so as to enable low speed operation of the engine in the event of failure of the solenoid valve or the control means therefor.

It is another object of the invention to provide a distributor type fuel injection pump which is adapted to selectively assume an injection mode using the solenoid valve and another injection mode not using the solenoid valve in response to fuel pressure within the suction space which is proportional to the rotational speed of the engine, thereby being simple in structure and low in cost.

A distributor type fuel injection pump according to the invention is constructed such that a plunger driven by the engine for concurrent reciprocating and rotative motion is formed therein with a plurality of suction ports identical in number with the cylinders of the engine and communicating with a pump working chamber defined at one end of the plunger. A first communication passageway communicates a suction space filled with fuel under pressure variable as a function of the rotational speed of the engine with the pump working chamber, while a second communication passageway having a restriction therein is disposed to sequentially register with the suction ports as the plunger rotates for communicating the suction space with each of the suction ports that registers with the second communication passageway. A solenoid valve is disposed to selectively open and close the first communication passageway. A selector valve is operable to assume, independently of the opening and closing action of the solenoid valve, a first valve position wherein the first communication passageway is closed and simultaneously the second communication passageway is opened, at the start of the engine, and a second valve position wherein the second communication passageway is closed and simultaneously the first communication passageway is opened, during operation of the engine other than at the start thereof. Further, control means is operable in response to operating conditions of the engine to control the solenoid valve to alternately open and close so as to achieve required fuel injection quantity and required injection timing.

The above and other objects, features and advantages of the invention will be more apparent from the ensuing detailed description taken in conjunction with the accompanying drawings.

DETAILED DESCRIPTION

Figure 1:
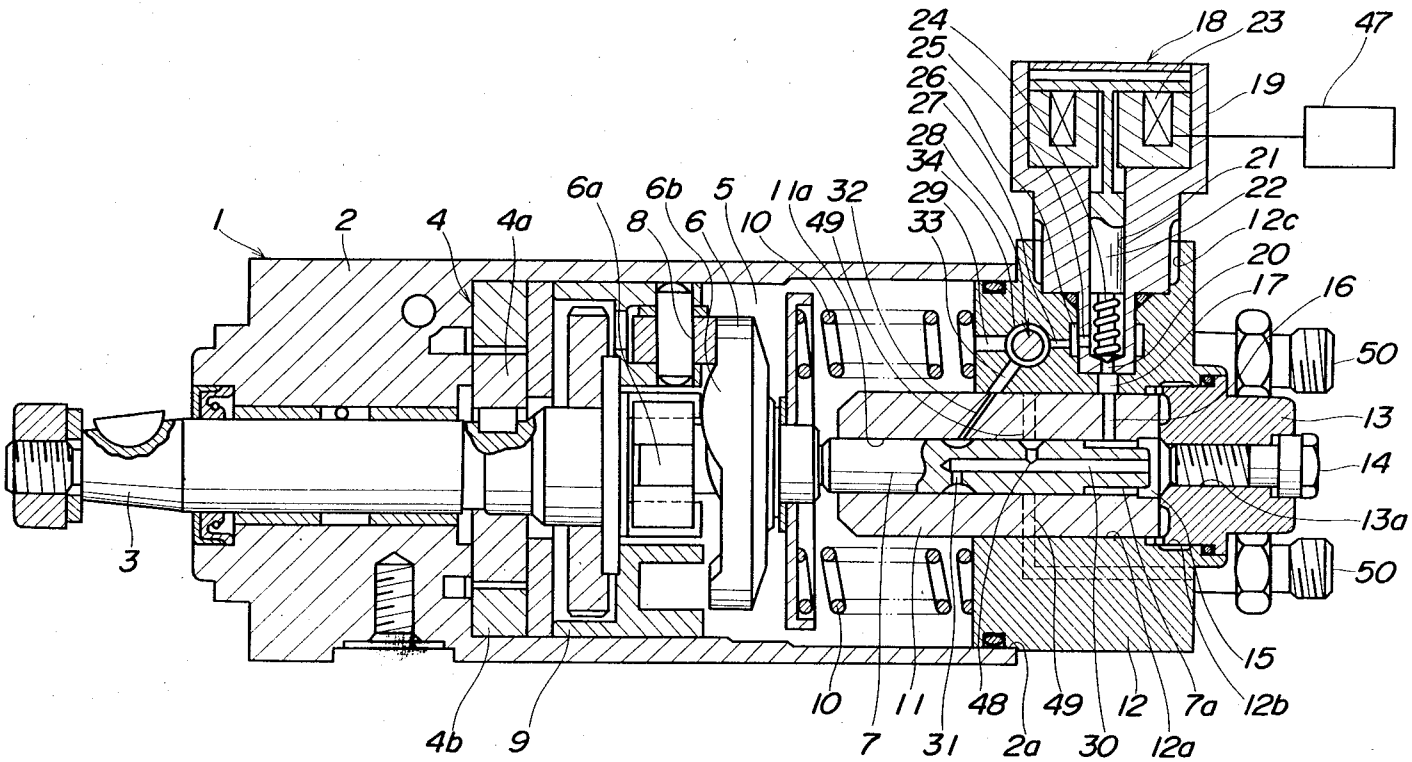
FIG. 1 is a longitudinal sectional view of a distributor type fuel injection pump according to an embodiment of the invention.

The invention will now be described in detail with reference to the drawings showing an embodiment thereof. Referring first to FIG. 1, reference numeral 1 designates a distributor type fuel injection pump according to the invention. A drive shaft 3 extends through a rear portion of a pump housing 2 and is drivenly connected to an output shaft of an engine, not shown. Secured on the drive shaft 3 is a rotor 4*a* of a vane type feed pump 4, of which vanes 4*b* are movably fitted in the rotor 4*a* for rotation in unison with the rotor 4*a* at speeds as a function of the rotational speed of the engine, to deliver pressurized fuel into a suction space 5 defined within the pump housing 2.

The drive shaft 3 has an inner or right end as viewed in FIG. 1 drivingly coupled to pawls 6*a* of a cam disc 6 secured to an inner or left end of a plunger 7. The cam disc 6 and the plunger 7 are thus disposed on the same axis as the drive shaft 3 and axially displaceable relative to the latter but prohibited from circumferential displacement relative thereto.

A roller holder 9 carrying a plurality of rollers 8 (only one of them is shown) is arranged around the junction between the drive shaft 3 and the cam disc 6, disposed in concentricity with the drive shaft 3 and immovably fixed to the pump housing 2 in a manner prohibited from circumferential displacement. The cam disc 6 has an inner end face 6*b* as a camming surface having a plurality of highs circumferentially arranged and identical in number with the cylinders of the engine. The camming surface 6*b* is disposed in urging contact with the rollers 8 by the force of a plurality of springs 10. Thus, as the drive shaft 3 rotates, the plunger 7 drivenly coupled thereto makes a reciprocating motion for suction and pressure delivery of fuel and a rotative motion for distribution of fuel to the engine cylinders at the same time, as is known.

The plunger 7 is slidably and rotatably received within a plunger bore 11*a* formed in a cylindrical plunger barrel 11 rigidly fitted in a block 12 which is fitted in an opening 2*a* in a right end face of the pump housing 2 in a liquid tight manner. The block 12 has a right end face thereof formed with a tapped bore 12*b* in which a head plug 13 is threadedly fitted in a liquid tight manner and in axial alignment with the plunger 7. A closing bolt 14 is threadedly fitted in a tapped through bore 13*a* formed in the head plug 13 in axial alignment with the plunger 7. Thus, a pump working chamber 15 is defined between an inner end face of the closing bolt 14, an end face of a head portion of the plunger 7, and an inner peripheral surface of the plunger bore 11*a*. The pump working chamber 15 communicates with a first port 20 formed in a valve housing 19 of a solenoid valve 18, by way of an annular recess 7*a* formed in an outer peripheral surface of the head portion of the plunger 7, a radial passage 16 formed through the peripheral wall of the plunger barrel 11 at a location closer to the pump working chamber 15, and a communication hole 17 formed in the block 12.

The solenoid valve 18 is operable to establish and interrupt communication between the suction space 5 and the pump working chamber 15. Part of the valve housing 19 is threadedly fitted in a tapped bore 12*c* formed in an upper peripheral surface of the block 12. The solenoid valve 18 is comprised of the valve housing 19, a valve body 22 slidably fitted within a valve chamber 21 defined within the valve housing 19, a solenoid 23 energizable to close the valve body 22, and a spring 24 fitted around an end portion of the valve body 22 to urge same in the valve opening or upward direction as viewed in FIG. 1. An inner end of the valve housing 19 is formed therein with the aforementioned first port 20 opening in a bottom face of the valve chamber 21, and a second port 25 opening in a lateral side face of the valve chamber 21. Thus, the communication between the first port 20 and the second port 25 can established and blocked by the valve body 22.

The second port 25 can be communicated with the suction space 5 by way of an annular groove 26 and a first passage 27, both formed in the block 12, a selector valve 28, and a second passage 29 also formed in the block 12.

The plunger 7 has an axial passage 30 in the form of a blind hole formed therein along its axis and opening at one end into the pump working chamber 15, and a plurality of suction ports 31 radially formed therein, opening in an outer peripheral surface thereof and communicating with the axial passage 30. The suction ports 31 are identical in number with the cylinders of the engine and circumferentially arranged in the plunger 7 at equal intervals. These suction ports 31 are so disposed as to sequentially register with a restriction passage 32 formed in an axially intermediate portion of the peripheral wall of the plunger barrel 11, as the plunger 7 rotates. The restriction passage 32 communicates with the selector valve 28 via a third passage 33 formed in the block 12, for communication with the suction space 5 through the second passage 29 to feed fuel from the suction space 5 to the pump working chamber 15, in place of the solenoid valve 18. The restriction passage 32 imparts a governing characteristic to the fuel injection pump that due to the throttling action of the restriction passage 32 and the decrease of the opening period of the suction ports 31 with the increase of the rotational speed of the pump or engine, the suction quantity of fuel through the restriction passage 32 decreases as the rotational speed increases, whereas the suction quantity increases as the rotational speed decreases. In view of this governing characteristic, the restriction passage 32 has its opening area set at such a suitable value as to avoid overrunning of the engine.

Figure 2:
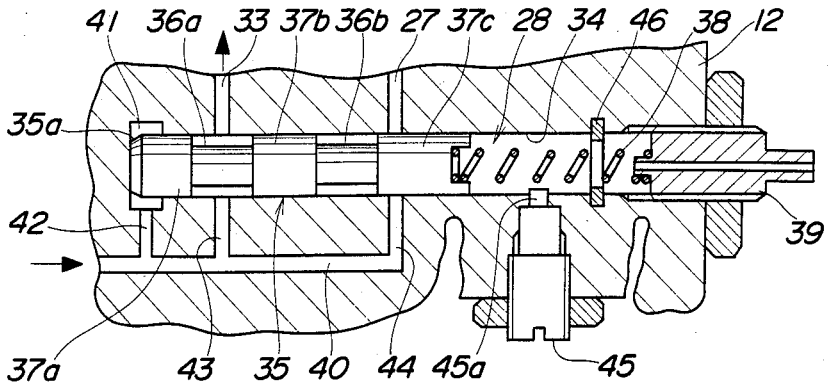
FIG. 2 is a longitudinal sectional view of a selector valve provided in the pump of FIG. 1, which is seen to assume a first valve position.

The selector valve 28 is operable to selectively assume a first valve position wherein the communication between the suction space 5 and the second port 25 of the solenoid valve 18 is blocked and simultaneously the communication between the suction space 5 and the suction ports 31 is established, and a second valve position wherein the communication between the suction space 5 and the suction ports 31 is blocked and simultaneously the communication between the suction space 5 and the solenoid valve 18 is established. The selector valve 28 has a valve body formed of a spool slidably received within a valve chamber 34 defined within the block 12, as shown in FIG. 2. The valve chamber 34 is formed by a blind hole having a circular cross section and extending from a lateral side wall surface of the block 12 toward the opposite one, and with which communicate the first passage 27 and the third passage 33. The valve body 35 has two annular grooves 36*a* and 36*b*, and three lands 37*a*, 37*b*, and 37*c*, and is urged in the leftward direction of assuming the first valve position by the force of a spring 38 interposed between an end of the spool valve body 35 and a spring setting load-adjusting screw member 39 threadedly fitted in a tapped end portion of the valve chamber 34.

Formed in the block 12 is a communication passage 40 communicating with the second passage 29, from which branch off a first branch passage 42 leading to a pilot chamber 41 defined at an inner end of the valve chamber 34, a second branch passage 43 for communication with the third passage 33 via the first annular groove 36*a* in the valve body 35, and a third branch passage 44 for communication with the first passage 27 via the second annular groove 36*b* in the valve body 35. With this arrangement, fuel pressure within the suction space 5 is transmitted into the pilot chamber 41 through the second passage 29, the communication passage 40 and the first branch passage 42 to act upon the associated end face 35*a* of the valve body 35. When the fuel pressure in the pilot chamber 41 exceeds the force of the spring 38, the valve body 35 will be moved into the second valve position.

Provided in the peripheral wall of the valve chamber 34 at predetermined axial locations are a first stopper 45 for keeping the spool valve body 35 in the second valve position against the fuel pressure during normal operation of the pump, and a second stopper 46 for keeping the valve body 35 in the first valve position in an emergency such as upon failure of the solenoid valve 18, a control unit 47, hereinafter referred to, etc. The first stopper 45 is formed by a screw member threadedly fitted in a radial tapped bore 12*c* formed in the block 12 and manually removable. The first stopper 45 can be manually rotated to have its inner end 45*a* move into and recede from the valve chamber 34, and normally is kept projected into the valve chamber 34 for urging contact with the end of the spool valve body 35 to keep same in the second valve position. The second stopper 46 is formed by a ring fitted in an inner peripheral surface of the valve chamber 34 at a location closer to the screw member 39 with respect to the first stopper 45. By withdrawing the inner end 45*a* of the first stopped 45 so that its tip recedes from the inner peripheral surface of the valve chamber 34, the spool valve body 35 will be moved into urging contact with the second stopper 46 by the fuel pressure against the force of the spring 38, and thus kept in a third valve position whereby the communication between the second branch passage 43 and the third passage 33 is established through the valve chamber 34, while simultaneously the communication between the third branch passage 44 and the first passage 27 is blocked by the land 37*b* of the valve body 35, thus providing substantially the same passage connection as in the first valve position which is assumed during normal operation of the pump.

The solenoid valve 18 is electrically connected to the electronic control unit 47 which determines operating conditions of the engine on the basis of output signals from various sensors, not shown, for sensing parameters including engine rotational speed, accelerator pedal position, engine cooling water temperature, exhaust gas ingredient concentration, etc. and controls the solenoid valve 18 in accordance with the determined operation conditions of the engine.

Referring again to FIG. 1, the plunger 7 also has a distributing port 48 radially formed therein at a location intermediate between the annular recess 7*a* and the suction ports 31 and communicating with the axial passage 30, whereas the plunger barrel 11 has a plurality of discharge ports 49 radially formed therein, which are identical in number with the cylinders of the engine and circumferentially arranged at equal intervals. As the plunger 7 rotates, the distributing port 48 sequentially registers with each of the discharge ports 49 to allow delivery of the pressurized fuel from the discharge port 49 to a corresponding one of injection nozzles, not shown, of the engine through a corresponding one of delivery valves 50 provided in the block 12 and identical in number with the cylinders of the engine.

Figure 3:
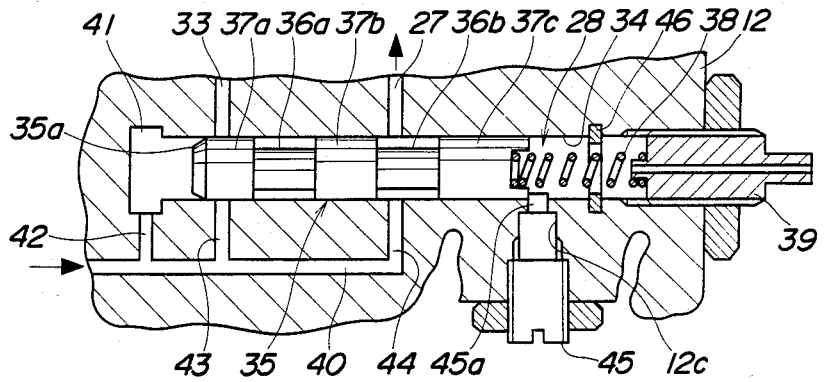
FIG. 3 is a view similar to FIG. 2, showing the selector valve in a second valve position.
Figure 4:
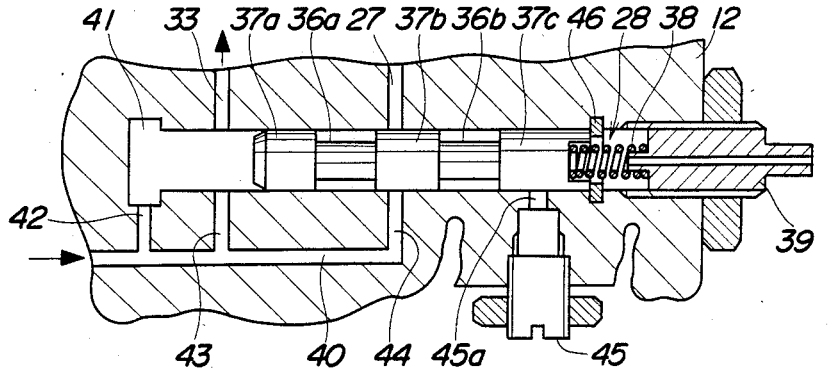
FIG. 4 is a view similar to FIG. 2, showing the selector valve in a third valve position.

The operation of the distributor type fuel injection pump constructed as above will be described with reference to FIGS. 2 to 4. First, at the start of the engine when the fuel pressure from the feed pump 4 is low, fuel which is fed from the suction space 5 to the pilot chamber 41 of the selector valve 28 through the second passage 29, the communication passage 40, and the first branch passage 42 to act upon the end face 35*a* of the spool valve body 35 is smaller than the counteracting force of the spring 38. Consequently, the valve body 35 is kept in the first valve position or leftward extreme position in FIG. 2 by the force of the spring 38. On this occasion, the communication between the third branch passage 44 from the communication passage 40 and the first passage 27 is blocked by the land 27*c* of the valve body 35, whereby no supply of fuel from the suction space 5 to the valve chamber 21 of the solenoid valve 18 takes place. Further, with the FIG. 2 valve position, the communication between the suction space 5 and the restriction pasage 32 is established through the second passage 29, the communication passage 40, the second branch passage 43, the first annular groove 36*a*, and the third passage 33 so that when each of the suction ports 31 registers with the restriction passage 32 during the suction stroke of the plunger 7 moving from the extreme position close to the pump working chamber 15 to the opposite extreme position remote from the chamber 15, fuel within the suction space 5 is fed through the second passage 29, the communication passage 40, the second branch passage 43, the first annular groove 36*a*, the third passage 33, the restriction passage 32, the same suction slit 32, and the axial passage 30 in the plunger 7, and sucked into the pump working chamber 15. Next, during the delivery stroke of the plunger 7 moving from the extreme position remote from the pump working chamber 15 to the opposite one close to the chamber 15, when the restriction passage 32 becomes disaligned with any of the suction ports 31 as the plunger 7 rotates, the fuel within the pump working chamber 15 and the axial passage 30 is increased in pressure by the movement of the plunger 7 toward the chamber 15, so that the fuel is pressure delivered through the distributing port 48 and the corresponding discharge port 49 registering therewith to be fed to the corresponding injection nozzle through the corresponding delivery valve 50, and injected into the combustion chamber of the corresponding cylinder of the engine. In this way, the fuel injection is effected under control of the suction flow rate of fuel through the restriction passage 32 of which the cross sectional area determines the injection quantity. Therefore, at the start of the engine, the suction and pressure delivery of fuel is automatically effected without the use of the solenoid valve 18, thereby achieving improved startability of the engine without being badly affected by degraded responsiveness of the solenoid valve 18, even in cold weather.

Then, as the rotational speed of the engine increases, the fuel pressure fed from the suction space 5 to the pilot chamber 41 of the selector valve 28 through the second passage 29, the communication passage 40 and the first branch passage 42 to act upon the end face 35*a* of the spool valve body 35 exceeds a predetermined value which can overcome the force of the spring 38. Then, the valve body 35 is displaced by the increased fuel pressure against the force of the spring 38 in the rightward direction as viewed in FIG. 2, until the right end face of the spool valve body 35 is brought into urging contact with the tip 45*a* of the first stopper 45, that is, into the second valve position shown in FIG. 3. In this second valve position, the communication between the third passage 33 and the second branch passage 43 is blocked by the land 37*a* of the valve body 35 and simultaneously the communication between the first passage 27 and the third branch passage 44 is established through the second annular groove 36*b* of the valve body 35. Thus, in the second valve position, the suction space 5 communicates with the valve chamber 21 of the solenoid valve 18 through the second passage 29, the communication passage 40, the third branch passage 44, the second annular groove 36*b*, the first passage 27, the annular groove 26, and the second port 25 of the solenoid valve 18. On this occasion, when the plunger 7 is on the suction stroke wherein it moves away from the pump working chamber 15, the control unit 47 does not supply electric current to the solenoid 23 of the solenoid valve 18 to deenergize same so that the valve body 22 is opened by the force of the spring 24. Accordingly, fuel from the suction space 5 is fed to the pump working chamber 15 and the axial passage 30 through the second passage 29, the communication passage 40, the third branch passage 44, the second annular groove 36*b*, the first passage 27, the annular groove 26, the second port 25 and first port 20 of the valve chamber 21, the communication hole 17, the radial passage 16, and the annular recess 7*a*.

When the plunger 7 is on the delivery stroke wherein it moves toward the pump working chamber 15, if the valve body 22 of the solenoid valve 18 is opened, the fuel thus sucked into the pump working chamber 15 is returned to the suction space 5 through the above passageway, so that no pressurization of fuel takes places within the chamber 15, and accordingly no injection of fuel takes places.

The electronic control unit 47 determines the injection staring timing and the injection quantity in response to operating conditions of the engine determined from the outputs from the aforementioned various parameter sensors, and first supplies a command signal to the solenoid valve 18 to energize its solenoid 23 when the plunger 7 on the delivery stroke has executed a stroke corresponding to the determined injection starting timing, with repect to the extreme position remote from the pump working chamber 15, whereby the valve body 22 of the solenoid valve 18 is magnetically attracted downward to descend against the force of the spring 24 to interrupt the communication between the suction space 5 and the radial passage 16. Then, as the plunger 7 further moves toward the pump working chamber 15, the fuel within the axial passage 30 in the plunger 7 and the pump working chamber 15 is pressurized, and the resulting high pressure fuel is delivered through the axial passage 30, the distributing port 48, the corresponding discharge port 49, the corresponding delivery valve 50, and the corresponding injection nozzle, to be injected into the combustion chamber of the corresponding engine cylinder.

Then, when the plunger 7 comes to a position close to the extreme position toward the pump working chamber 15, the electronic control unit 47 generates a command signal commanding the termination of injection at a time corresponding to the determined injection quantity to thereby interrupt supply of electric current to the solenoid valve 18 to open same. Consequently, the high pressure fuel within the axial passage 30 and the pump working chamber 15 escapes to the suction space 5 through the annular recess 7*a*, the radial passage 16, the communication hole 17, the first port 20, the valve chamber 21, the second port 25, the annular groove 26, the first passage 27, the second annular groove 36*b*, the third branch passage 44, the communication passage 40, and the second passage 29, so that the fuel pressure within the pump working chamber 15 drops to terminate the fuel delivery.

Following the termination of fuel injection, the plunger 7 starts moving away from the pump working chamber 15 to execute the suction stroke wherein the fuel within the suction space 5 is again sucked into the pump working chamber 15 and the axial passage 30 in the plunger 7 through the same passageway as that stated before, until it reaches the extreme position remote from the pump working chamber 15.

As stated above, the timing of closing the solenoid valve 18 determines the injection starting timing, while the timing of opening the valve 18 determines the valve closing period, i.e. the injection quantity.

When the temperature of the engine sensed by the aforementioned engine cooling water temperature sensor is lower than a predetermined value, the electronic control unit 47 continually supplies electric current to the solenoid valve 18 immediately upon and immediately after the start of the engine to keep the valve 18 closed. When the engine temperature thereafter rises above the predetermined value, preferably almost at the same time the selector valve 28 moves to the second valve position to open the first passage 27, the control unit 47 stops energizing the solenoid valve 18 to open same, and thereafter alternately energizes and deenergizes the valve 18 for ordinary suction and delivery of fuel.

Thus, when the engine operation shifts into an operative state other than the start of the engine, wherein the engine temperature has increased to a suitable level and the engine rotational speed has also increased to a suitable level, the timing of opening and closing the solenoid valve 18 is controlled by the electronic control unit 47 to achieve desired injection quantity and desired injection timing.

Further, according to the invention, when the solenoid valve 18 per se or the electronic control unit 47 fails, the fuel injection pump can continually perform fuel injection by means of the restriction passage 32 in substantially the same manner as when the selector valve 28 is in the first valve position, as an emergency measure. That is, in such event, the operator manually rotates the first stopper 45 to cause its tip 45*a* to recede from the valve chamber 34, while setting the setting load of the spring 38 to a minimum value by adjusting the position of the adjusting screw member 39. Then, even a small fuel pressure from the suction space 5 acting upon the end face 35*a* of the spool valve body 35 will cause rightward displacement of the valve body 35 into the third valve position shown in FIG. 4 wherein the right end of the valve body 35 is in urging contact with the second stopper 46 since the setting load of the spring 38 has been set to the minimum value. In this third valve position, the communication between the first passage 27 leading to the solenoid valve 18 and the third branch passage 44 leading to the suction space 5 is blocked by the land 37*b* of the spool valve body 35. At the same time, communication is established between the third passage 33 leading to the restriction passage 32 and the second branch passage 43 leading to the suction space 5, through the valve chamber 34. As a consequence, communication is established between the suction space 5 and the restriction passage 32 through the second passage 29, the communication passage 40, the second branch passage 43, the valve chamber 35, and the third passage 33 to obtain a passage connection substantially the same with that obtained when the selector valve 28 assumes the aforementioned first valve position, whereby fuel injection is carried out with such injection quantities as to permit engine operation at low speeds. The suction, pressure delivery and injection of fuel with the selector valve 28 in this third valve position are effected in the same manner as in the case where the valve 28 assumes the first valve position, and description of which is therefore omitted.

According to the arrangement of the invention described above, at the start of the engine in cold weather in particular, fuel injection can be performed even without using the solenoid valve 18, thereby achieving improved startability of the engine and also making it unnecessary to employ a solenoid valve with very high responsiveness as the solenoid valve 18. Moreover, in the event of failure in the solenoid valve 18, the control unit 47, etc., continued operation of the engine is feasible under a minimum required condition by immediately changing the selector valve 28 to the third valve position as an emergency measure. Furthermore, the selector valve 28 can automatically be changed in position from the first valve position to the second valve position with an increase in the fuel pressure within the suction space 5 proportional to the rotational speed of the engine above a certain level, dispensing with the use of a special solenoid valve for such position changing, thereby being simple in structure and low in cost.

While a preferred embodiment of the invention has been described, variations thereto will occur to those skilled in the art within the scope of the present invention concepts which are delineated by the appended claims.

What is claimed is:

1. A distributor type fuel injection pump for an internal combustion engine, comprising: a suction space filled with fuel under pressure variable as a function of the rotational speed of said engine; a plunger driven by said engine for concurrent reciprocating and rotative motion to effect suction of fuel from said suction space into a pump working chamber defined by said plunger at one end thereof, pressure delivery of fuel from said pump working chamber and distribution of the fuel into cylinders of said engine; a plurality of suction ports formed in said plunger and identical in number with the cylinders of said engine, said suction ports communicating with said pump working chamber; a first communication passageway communicating said suction space with said pump working chamber; a second communication passageway having a restriction therein, said second communication passageway being disposed to sequentially register with said suction ports as said plunger rotates for communicating said suction space with each of said suction ports that registers with said second communication passageway; a solenoid valve disposed to selectively open and close said first communication passageway; a selector valve operable to assume, independently of the opening and closing action of said solenoid valve, a first valve position wherein said first communication passageway is closed and simultaneously said second communication passageway is opened, at the start of said engine, and a second valve position wherein said second communication passageway is closed and simultaneously said first communication passageway is opened, during operation of said engine other than at the start of said engine; and control means operable in response to operating conditions of said engine to control said solenoid valve to alternately open and close so as to achieve required fuel injection quantity and required injection timing.

2. A distributor type fuel injection pump as claimed in claim 1, wherein said selector valve is operable in response to fuel pressure within said suction space such that it assumes said first valve position when the fuel pressure within said suction space is lower than a predetermined value, and assumes said second valve position when the fuel pressure within said suction space is higher than said predetermined value.

3. A distributor type fuel injection pump as claimed in claim 2, wherein said selector valve comprises a spool valve body displaceable to selectively open and close said first communication passageway and said second communication passageway, fuel pressure supplying means for causing the fuel pressure within said suction space to act upon said spool valve body at one end face thereof so as to assume said first valve position, and spring means urging said spool valve body at another end face thereof against the fuel pressure acting upon said spool valve body at said one end face thereof.

4. A distributor type fuel injection pump as claimed in claim 1, wherein said control means is operable in response to a temperature of said engine such that said solenoid valve is kept closed when said temperature of said engine is lower than a predetermined value, and said solenoid valve is permitted to effect said alternate opening and closing when said temperature of said engine rises above said predetermined value.

5. A distributor type fuel injection pump as claimed in claim 2, including emergency means for maintaining said selector valve in said first valve position at human will, irrespective of the fuel pressure within said suction space.

* * * * *